US006733549B2

(12) United States Patent
Hüffer et al.

(10) Patent No.: US 6,733,549 B2
(45) Date of Patent: May 11, 2004

(54) FUEL-WATER EMULSIONS CONTAINING POLYBUTENE-BASED EMULSIFYING AGENTS

(75) Inventors: Stephan Hüffer, Ludwigshafen (DE); Michael Stang, Ludwigshafen (DE); Paul Klingelhöfer, Mannheim (DE); Ansgar Eisenbeis, Georgsmarienhuette (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/181,438

(22) PCT Filed: Jan. 17, 2001

(86) PCT No.: PCT/EP01/00496

§ 371 (c)(1),
(2), (4) Date: Jul. 25, 2002

(87) PCT Pub. No.: WO01/55282

PCT Pub. Date: Aug. 2, 2001

(65) Prior Publication Data

US 2003/0024852 A1 Feb. 6, 2003

(30) Foreign Application Priority Data

Jan. 25, 2000 (DE) ..... 100 03 105

(51) Int. Cl.[7] ..... C10L 1/32

(52) U.S. Cl. ..... 44/301; 44/302; 44/384; 44/443; 44/447

(58) Field of Search ..... 44/301, 302, 300

(56) References Cited

U.S. PATENT DOCUMENTS

| | | | | | |
|---|---|---|---|---|---|
| 2,111,100 | A | | 3/1938 | Kokatnur | |
| 3,346,494 | A | | 10/1967 | Robbins et al. | |
| 3,902,869 | A | | 9/1975 | Friberg et al. | |
| 4,659,336 | A | * | 4/1987 | Sung et al. | 44/407 |
| 4,659,337 | A | * | 4/1987 | Sung | 44/407 |
| 4,832,702 | A | * | 5/1989 | Kummer et al. | 44/412 |
| 4,859,210 | A | * | 8/1989 | Franz et al. | 44/333 |
| 4,877,416 | A | * | 10/1989 | Campbell | 44/432 |
| 5,131,921 | A | * | 7/1992 | Sung et al. | 44/391 |
| 6,533,830 | B1 | * | 3/2003 | Oppenlander et al. | 44/443 |

FOREIGN PATENT DOCUMENTS

| | | | |
|---|---|---|---|
| GB | 1097696 | * | 3/1965 |
| WO | 97/34969 | | 9/1997 |
| WO | 98/56878 | | 12/1998 |

* cited by examiner

*Primary Examiner*—Margaret B. Meldey
(74) *Attorney, Agent, or Firm*—Oblon, Spivak, McClelland, Maier & Neustad, P.C.

(57) ABSTRACT

Fuel-water emulsions in which an alkoxylated, preferably an ethoxylated, polyisobutene is used as an emulsifier are described. Stable emulsions, in particular of diesel-water mixtures, which have advantageous properties when used as fuel in internal combustion engines can be prepared in this manner.

16 Claims, No Drawings

FUEL-WATER EMULSIONS CONTAINING POLYBUTENE-BASED EMULSIFYING AGENTS

The present invention relates to fuels which are used in internal combustion engines, preferably diesel engines, and which are emulsions of the respective fuel type with water. Emulsifiers which are derived from polyisobutene are used for the preparation and stabilization of these emulsions, and polyisobutene ethoxylates are preferably used.

The internal combustion engines known today are operated with different fuels depending on the intended use. Most well known are gasoline engines which burn readily volatile gasoline fuels and diesel engines in which more sparingly volatile diesel fuels are used. However, there are also internal combustion engines in which other fuels are used and some of which have a design which differs from that of the abovementioned internal combustion engines. Only the use of light and heavy heating oil in, for example, ships' engines and of kerosene in aircraft engines is mentioned here.

In all these internal combustion engines, the object is to carry out the combustion of the fuel in such a way that high efficiency results and at the same time the emission of pollutants is as low as possible. The addition of water to the fuels has long been known for this purpose. The objects described above are in principle most simply and most economically achieved in this manner. The fundamental problem which arises with the use of such fuel/water mixtures is that the components which are immiscible with one another have to be fed to the engine in the form of a fine mixture, generally an emulsion. Emulsions of the water-in-oil type in which the water is present as the dispersed phase in the continuous oil phase, i.e. in the fuel, are generally used. Specific emulsifiers are used for the preparation and stabilization of the emulsion.

The use of particularly finely divided emulsions or of microemulsions is particularly preferred. These are emulsions in which the size of the droplets dispersed in the continuous phase is very small, preferably $\leqq 1\ \mu m$.

The prior art contains several references which describe the preparation of fuel/water mixtures by various methods.

U.S. Pat. No. 2,111,100 discloses a clear engine fuel comprising at least 50% of fuel, at least 5% of water, at least 5% of an organic solvent selected from the group consisting of alcohols, ketones, ethers and aldehydes, and a fatty acid salt as emulsifier. The water content of the mixture may be up to 50%.

U.S. Pat. No. 3,346,494 describes an emulsifier system for water-in-oil emulsions which consists of from 1 to 10 parts of a fatty acid of 12 to 20 carbon atoms, from 1 to 10 parts of an alkylamino alcohol having 2 to 5 carbon atoms per alkyl group and from 1 to 10 parts of an alkylated phenol having at least one alkyl group of 8 to 12 carbon atoms. The emulsifier system can be used, inter alia, for stabilizing water-in-fuel microemulsions.

U.S. Pat. No. 3,902,869 describes a water-in-fuel microemulsion which contains from 5 to 40% by weight of water and from 1 to 35% by weight of an emulsifier which consists of a suitable carboxylic acid and a salt of this carboxylic acid. Suitable acids are, for example, naphthenic acids, resin acids and gallic acid. In order to increase the octane number, suitable metal salts are also added to the mixture.

WO 98/56878 discloses an emulsion of up to 37% of an aqueous $C_1$–$C_4$-alcohol in diesel fuel, at least one nonionic surfactant selected from alkoxyphenol, sorbitan monooleate, oleodiethanolamide and glyceryl monooleate being used as emulsifiers. The mixtures have a low soot pollutant emission during combustion.

Finally, WO 97/34969 discloses a water-in-fuel microemulsion which contains at least 5% by weight of water and which was prepared using an emulsifier system which has three fundamental components. These three components are (a) at least one specific sorbitol ester, (b) at least one specific fatty ester and (c) a specific polyalkoxylated alkylphenol. These emulsions have an HLB (hydrophilic-lipophilic balance) of from 6 to 8.

Up to the present, however, none of the water-in-fuel emulsions described in the prior art meet the requirements set for them. On the one hand, the emulsions frequently have insufficient stability, resulting in phase separation during storage. The emulsifier systems used are often complicated and expensive. The most important point, however, is that emulsifier systems used to date and required for the preparation and stabilization of the microemulsion lead to coking residues and deposits in the engine.

It is an object of the present invention to provide emulsifier systems which permit the preparation of water-in-fuel emulsions and do not have the disadvantages described above. In particular, these emulsifier systems should permit the preparation of water-in-diesel emulsions.

We have found that this object is achieved by using alkoxylated polyisobutene as an emulsifier in the preparation of water-in-fuel emulsions.

We have found that this object is furthermore achieved by a fuel-water emulsion containing from 95 to 60% by weight of fuel, from 3 to 35% by weight of water and from 0.2 to 10% by weight of an alkoxylated polyisobutene as emulsifier.

In a preferred embodiment of the present invention, the fuel which forms the continuous phase in the novel emulsions is diesel fuel.

The emulsifiers used in the present invention for the preparation of water-in-fuel emulsions are alkoxylates of polyisobutene. They belong to the surfactant group and can be described by the formula $$R(CH_2)_n(O—A)_m—OH.$$

Here, R is a polyisobutene having a weight average molar mass (Mn) of from 300 to 2300, preferably from 500 to 2000. A is an alkylene radical of 2 to 8 carbon atoms, m is a number from 1 to 200 which is chosen so that the alkoxylated polyisobutene contains from 0.2 to 1.5 alkylene oxide units per $C_4$ unit, preferably 0.5 alkylene oxide unit per $C_4$ unit, n is either 0 or 1.

In a preferred embodiment of the present invention, A is an ethylene radical. Ethoxylated polyisobutene is thus preferably used. It is furthermore preferred if, in the polyisobutene alkoxylates or ethoxylates used, the proportion of polymers in which n is 1 is from 75 to 95%.

These alkoxylated polyisobutenes are prepared from the corresponding polyisobutenes. If such a polyisobutene has a terminal double bond, it is converted into the corresponding primary alcohol by hydroformylation and then reacted with the corresponding alkylene oxide, preferably ethylene oxide, in a manner known per se. Polyisobutenes having a geminal double bond are converted, prior to the alkoxylation, into the corresponding alcohol in another manner known per se, for example by epoxidation and subsequent reduction.

The polyisobutene alkoxylates used in the present invention are disclosed in the German Application having the title Polyalkenalkohol-Polyalkoxylate und deren Verwendung in Schmier- und Kunststoffen [Polyalkenyl alcohol polyalkoxylates and their use in lubricants and fuels] of BASF AG of Feb. 25, 1999. That part of this Application which relates to these alkoxylated polyisobutenes and their preparation is an integral part of the present invention and is hereby incorporated by reference into the present Application.

The alkoxylated polyisobutenes used according to the invention have an HLB of from 2 to 6, preferably from 3 to 5. HLB is hydrophilic-lipophilic balance and is a well known parameter for characterizing surfactants. An exact definition of this parameter appears in: Emulsions: Theory and Practice, Paul Becher, Reinhold Publishing Corporation, ACF Monograph, Ed. 1965, Chapter entitled The Chemistry of Emulsifying Agents, page 232 et seq.

The alkoxylated polyisobutene is used in the novel fuel-water emulsions in amounts of from 0.2 to 10, preferably from 0.5 to 5, % by weight. These emulsions furthermore have a fuel content of from 60 to 95, preferably from 70 to 90, % by weight and a water content of from 3 to 35, preferably from 10 to 25, % by weight.

In one embodiment of the invention, the water used in the novel emulsions may contain a certain amount of one or more $C_1$–$C_4$-alcohols. The amount of alcohol which is used is from 5 to 50% by weight, based on the amount of water. By adding alcohol, the temperature range in which the emulsion is stable can be broadened.

In addition to the abovementioned constituents, fuel, water, alkoxylated polyisobutene and, if required, $C_1$–$C_4$-alcohol, the emulsions according to the present invention may also have further components. These are, on the one hand, further surfactants, which likewise serve as emulsifiers. For example, sodium lauryl sulfate, quaternary ammonium salts, alkyl glycosides, lecithins, polyethylene glycol ethers, sorbitan oleates, stearates and ricinoleates and polyethylene glycol esters, preferably sorbitan monooleate, $C_{13}$ oxo alcohol ethoxylates and alkylphenol ethoxylates, for example octyl- and nonylphenol ethoxylates, are suitable for this purpose. Good results could be obtained if a combination of these preferred further surfactants together with an ethoxylated polyisobutene was used. If these further surfactants are used, they are employed in amounts of from 0.5 to 5, preferably from 1 to 2.5, % by weight, based on the total composition. The amount of this further surfactant is chosen so that the total amount of surfactant, i.e. alkoxylated polyisobutene plus further surfactant, does not exceed the amount of from 0.2 to 10% by weight stated for the alkoxylated polyisobutene alone.

In the present invention, fuel-water emulsions of all conventional fuel types can be prepared. Examples of preferred fuels are diesel fuel, kerosene, and heavy and light heating oil. In the most preferred embodiment, the fuel is diesel fuel.

The novel fuel-water emulsions have high stability and good efficiency during combustion. It is furthermore possible to obtain good exhaust values, the emission of soot and $NO_x$ being significantly improved, in particular in the case of diesel engines. In particular, complete and residue-free combustion without deposits on the assemblies of the combustion apparatus, for example injection nozzles, pistons, annular grooves, valves and cylinder head, can be achieved.

For the preparation of the novel water-in-fuel microemulsions, the chosen alkoxylated polyisobutene is mixed with the fuel, the water and the further components which may be optionally used, and emulsification is effected in a manner known per se. For example, the emulsification can be carried out in a rotor mixer or by means of a mixing nozzle or an ultrasonic probe. Particularly good results are obtained when a mixing nozzle of the type disclosed in German Application 198 56 604 of BASF AG of Dec. 8, 1998 was used.

In all these processes, the procedure is chosen so that, in the resulting emulsions, the mean droplet size of the emulsified phase is from 0.5 to 5 $\mu$m, preferably <2 $\mu$m. Such values can be readily achieved using the emulsifier system chosen in the present invention.

The examples which follow illustrate the invention.

EXAMPLES 1 TO 6 AND COMPARATIVE EXAMPLES 1 AND 2

The procedure was such that the water-soluble components were dissolved in the aqueous phase and the oil-soluble components in the fuel, in this case diesel oil. In examples 1 to 4, the emulsification was effected in a mixing nozzle as disclosed in German Application 198 56 604 of BASF AG of Dec. 8, 1998. The pressure in the mixing apparatus was from 50 to 200, preferably 120, bar (before the aperture) at a total throughput of 12 kg/h. In examples 5 and 6, a rotor mixer of the Ultra-Turrax® type (Jahnke and Kunkel laboratory apparatus T 25) was used instead of the mixing nozzle, 500 g samples being prepared over 15 minutes at a speed of 24000 $min^{-1}$.

The composition of the samples is shown in table 1 below.

TABLE 1

| Example | Composition of the emulsions | | | | | | | |
|---|---|---|---|---|---|---|---|---|
| Component [% by wt.] | Ex. 1 | Ex. 2 | Comp. ex. 1 | Ex. 3 | Comp. ex. 2 | Ex. 4 | Ex. 5 | Ex. 6 |
| $PIB_{550}5EO$ | 0.6 | | | 1.0 | | 1.0 | Analogous to ex. 1 | Analogous to comp. ex. 1 |
| $PIB_{550}10EO$ | | 0.6 | | | | | | |
| Sorbitan oleate S-Maz 80* | 0.4 | 0.4 | 0.9 | 0.9 | 1.6 | 0.9 | | |
| $C_{13}$ oxo alcohol ethoxylate (7EO) | 0.3 | 0.3 | 0.4 | 0.6 | 0.9 | 0.6 | Preparation using rotor mixer | Preparation using rotor mixer |
| Alkyphenol ethoxylate | 0.2 | 0.2 | 0.2 | 0.4 | 0.4 | 0.4 | | |
| Diesel (EN 590)** | 78 | 78 | 78 | 76.6 | 76.6 | 76.6 | | |
| Water | 20 | 20 | 20 | 20 | 20 | 15 | | |
| Methanol | | | | | | 5 | | |

TABLE 1-continued

| Example Component [% by wt.] | Composition of the emulsions | | | | | | | |
|---|---|---|---|---|---|---|---|---|
| | Ex. 1 | Ex. 2 | Comp. ex. 1 | Ex. 3 | Comp. ex. 2 | Ex. 4 | Ex. 5 | Ex. 6 |
| Ammonium nitrate | 0.5 | 0.5 | 0.5 | 0.5 | 0.5 | 0.5 | | |

*Origin: BASF Corporation, U.S.A.
**EN = European standard

The emulsions were investigated using an optical microscope. The emulsions of examples 1 and 2 and of comparative example 1 have water drops in the size range of from 1 to 10 μm with a main fraction of from 1 to 3 μm. Examples 3 and 4 and comparative example 2 could not be unambiguously determined with respect to the particle sizes and the size distribution, because of the Brownian molecular movement owing to a large fraction of droplets <1 μm. The samples of examples 5 and 6 contained water drops having a size of from 1 to 20 μm and thus have the broadest size distribution.

The stability of the emulsion was checked in a static storage test at 20° C. and additionally at varying temperatures (0° C., 40° C. and 70° C.). It was found that emulsions of examples 1 and 4 and of comparative examples 1 and 2 were completely stable over three months with respect to their homogeneity. The samples from examples 5 and 6 had a somewhat reduced stability owing to the broad size distribution of the droplets and showed slight phase separation even before the elapse of 3 months on storage at 40° C.

Some of the abovementioned fuel-water emulsions were then investigated with respect to their combustion behavior. A stationary test using a Peugeot diesel engine of the type XUD 9, 45 kW, 1.9 1, was carried out. The test was performed similarly to the specifications contained in the draft for European standard CEC-PF 023. A 6-hour cycle at variable speed and power take-off was chosen. The cleanliness of the combustion chamber was then determined quantitatively. Deposits on the injection nozzles were determined on the basis of the flow reduction according to DIN, in %. Particulate emissions (soot) were determined by the Bosch method. The results are shown in table 2 below.

TABLE 2

| | Diesel (standard EN 590) | Emulsion Example 1 | Emulsion Comp. example 1 | Emulsion Example 3 | Emulsion Comp. example 2 |
|---|---|---|---|---|---|
| Deposits in combustion chamber [mg/cylinder] | 600 | 240 | 640 | 260 | 890 |
| Injection nozzles Red. flow [%] | 40 | 48 | 68 | 45 | 74 |
| Soot emission Soot number* | 1.5 | 0.6 | 0.6 | 0.3 | 0.4 |
| Relative fuel consumption | 100 | 0.92 | 0.94 | 0.93 | 0.91 |

*Based on hydrocarbon

We claim:

1. A method comprising:

mixing an alkoxylated polyisobutene, water and a fuel to form a water-in-fuel emulsion.

2. The method as claimed in claim 1, wherein the alkoxylated polyisobutene is an ethoxylated polyisobutene.

3. The method as claimed in claim 1, wherein the alkoxylated polyisobutene comprises (a) a polyisobutene unit comprising a plurality of polymerized $C_4$ units, and (b) a plurality of alkylene oxide units bonded to the polyisobutene unit, wherein the polyisobutene unit has a number average molar mass Mn of from 300 to 2300, and wherein from 0.2 to 1.5 alkylene oxide units are present per $C_4$ unit.

4. The method as claimed in claim 1, wherein the alkoxylated polyisobutene comprises (a) a polyisobutene unit comprising a plurality of polymerized $C_4$ units, and (b) a plurality of alkylene oxide units bonded to the polyisobutene unit, wherein the polyisobutene unit has a number average molar mass Mn of from 500 to 2000.

5. The method as claimed in claim 3, wherein 0.5 alkylene oxide units are present per $C_4$ unit.

6. The method as claimed in claim 1, wherein the alkoxylated polyisobutene has an HLB of from 2 to 6.

7. The method as claimed in claim 1, wherein the alkoxylated polyisobutene has an HLB of from 3 to 5.

8. The method as claimed in claim 1, wherein mixing comprises emulsifying the alkoxylated polyisobutene, water and the fuel in a mixing nozzle.

9. A water-in-fuel emulsion obtained by the method as claimed in claim 1, wherein the water-in-fuel emulsion comprises from 60 to 95% by weight of the fuel, from 3 to 35% by weight of water and from 0.2 to 10% by weight of the alkoxylated polyisobutene.

10. The emulsion as claimed in claim 9, comprising from 0.5 to 5% by weight of the alkoxylated polyisobutene.

11. The emulsion as claimed in claim 9, wherein the fuel is a diesel fuel.

12. The emulsion as claimed in claim 9, further comprising one or more surfactants.

13. The emulsion as claimed in claim 12, wherein the surfactants are selected from the group consisting of sorbitan oleate, $C_{13}$ oxo alcohol ethoxylates and alkylphenol ethoxylates.

14. The emulsion as claimed in claim 9, wherein the mean droplet size of an emulsified phase present in the water-in-fuel emulsion is from 0.5 to 5 $\mu$m.

15. The emulsion as claimed in claim 14, wherein the mean droplet size is <2 $\mu$m.

16. The method as claimed in claim 1, further comprising mixing a $C_1$–$C_4$-alcohol with the alkoxylated polyisobutene, water and the fuel, wherein the $C_1$–$C_4$-alcohol is present in an amount of from 5 to 50% by weight.

* * * * *

UNITED STATES PATENT AND TRADEMARK OFFICE

CERTIFICATE OF CORRECTION

PATENT NO. : 6,733,549 B2
DATED : May 11, 2004
INVENTOR(S) : Hüffer et al.

It is certified that error appears in the above-identified patent and that said Letters Patent is hereby corrected as shown below:

Title page, Item [54] and Column 1, lines 1-3,
Title, should read: FUEL-WATER EMULSIONS CONTAINING POLYISOBUTENE-BASED EMULSIFYING AGENTS --

Signed and Sealed this

Thirtieth Day of November, 2004

JON W. DUDAS
*Director of the United States Patent and Trademark Office*